US006250231B1

(12) United States Patent
Karasek

(10) Patent No.: US 6,250,231 B1
(45) Date of Patent: Jun. 26, 2001

(54) CONNECTION BETWEEN TWO VEHICLE PARTS OF AN ARTICULATED VEHICLE

(75) Inventor: Jens Karasek, Kaufungen (DE)

(73) Assignee: Hubner Gummi-und Kunststoff GmbH, Kassel (DE)

( * ) Notice: Subject to any disclaimer, the term of this patent is extended or adjusted under 35 U.S.C. 154(b) by 0 days.

(21) Appl. No.: 09/314,754

(22) Filed: May 19, 1999

(30) Foreign Application Priority Data

Sep. 2, 1998 (DE) ..... 298 15 615 U
Nov. 7, 1998 (DE) ..... 298 19 951 U

(51) Int. Cl.[7] ..... B61D 17/00
(52) U.S. Cl. ..... 105/3; 105/4.1; 105/8.1; 280/403
(58) Field of Search ..... 105/3, 8.1, 4.1, 105/17; 280/403

(56) References Cited

U.S. PATENT DOCUMENTS 3,712,243 * 1/1973 Pangalila ..... 105/3
3,884,155 * 5/1975 Maroshick ..... 105/3
4,405,143 * 9/1983 Rosenkrands ..... 280/403
4,421,339 * 12/1983 Hagin ..... 105/3
4,455,033 * 6/1984 Becker et al. ..... 280/403
4,458,911 * 7/1984 Chadwick et al. ..... 280/403
5,052,707 * 10/1991 Timan ..... 280/403
5,197,392 * 3/1993 Jeunehomme ..... 105/3

* cited by examiner

*Primary Examiner*—S. Joseph Morano
*Assistant Examiner*—Lars A. Olson
(74) *Attorney, Agent, or Firm*—Thomas R. Vigil

(57) ABSTRACT

The subject matter of the invention is a connection between two vehicle parts of an articulated vehicle, more particularly of an articulated rail vehicle, whereas the two vehicle parts (1, 10) are pivotably connectable in the roof area of the vehicle parts (1, 10) thanks to a slidable lattice stand (40) extending across the longitudinal axis of the articulated vehicle.

8 Claims, 2 Drawing Sheets

CONNECTION BETWEEN TWO VEHICLE PARTS OF AN ARTICULATED VEHICLE

CROSS-REFERENCE TO RELATED APPLICATIONS

This application claims priority under 35 U.S.C. 119 from German Applications Nos. 298 15 615.6 filed Sep. 2, 1998 and 298 19 951.3 filed Nov. 7, 1998

BACKGROUND OF THE INVENTION

1. Field of the Invention.

The present invention relates to a connection between two vehicle parts of an articulated vehicle, more particularly of an articulated rail vehicle.

2. Description of the Prior Art

A big variety of articulated connections between vehicle parts hinge-linked to each other is known; it is known in particular that the lower plain bearing has to receive all the forces occurring in radial or in axial direction. That means that said lower plain bearing serves to transmit such forces as they are for example occurring when driving a curve, as well as the push and pull forces intervening during the traction or the braking of such an articulated vehicle.

Vehicles, and more particularly vehicles that are hinge-linked to each other, are submitted to many other influences of force resulting in a plurality of movements of the vehicle parts relative to each other. These are influences of movements as they are taking place when such an articulated vehicle is driving a curve, but also movements of the vehicle parts relative to each other, when such a vehicle is driving through depression or over a hilltop. Additionally to these nodding movements, so-called swaying movements of the vehicle parts relative to each other are also occurring when the vehicle parts are displaced relative to each other.

Now the envelope curve, particularly of articulated rail vehicles, has to stay relatively small. Envelope curve means here the radial space altogether required by the vehicle during the travelling motion of said vehicle. Extreme swaying movements of the vehicle parts relative to each other particularly occasion a big envelope curve. Such a big envelope curve is not desired, since much more space has to be provided on the railway track for the vehicle. To provide a big space for the travelling motion of the vehicle is expensive, which is of particular significance for the construction of subways.

Many different measures are known to limit the swaying movements of vehicle parts relative to each other. Particularly in sharp curves when nodding movements are simultaneously occurring or when the nodding movements are extremely strong, these measures often make it necessary to provide recesses in the front of the vehicle parts at the corresponding places.

SUMMARY OF THE INVENTION

The object of the present invention is therefore to provide a connection of the type mentioned above that permits a nodding movement of the vehicle parts relative to each other, but that is preventing swaying movements of the vehicle parts relative to each other without having to take any particular measure on the vehicle parts.

The solution of the present invention is that the two vehicle parts are pivotably connectable in the roof area of the vehicle parts thanks to a slidable lattice stand extending across the longitudinal axis of the articulated vehicle. By arranging the slidable lattice stand across the longitudinal axis of the vehicle, swaying movements are avoided, whereas even extreme nodding movements are possible without having to provide the front of the vehicle parts with recesses. It is necessary for the vehicles to be also pivotable in the roof area, since only then, curves may be driven. Thus, the slidable lattice stand is pivotably connected with the opposite or other vehicle part. No particular measures have to be taken to provide recesses at the front of the vehicle parts, even when nodding movements of the vehicle parts relative to each other are occurring when such a vehicle is driving a very sharp curve. Indeed, the slidable lattice stand is building up vertically and not in the direction of the front side of the other, opposite vehicle part.

The slidable lattice stand is more particularly designed as a joint hinge extending across the longitudinal axis of the articulated vehicle, whereas the ends of the joint hinge may be hinge-linked with either of the vehicle parts. This clearly shows that swaying movements of the vehicle parts relative to each other are avoided and that nodding movements are tolerated without recesses having to be provided on the front side of the vehicle parts—as already explained. The slidable lattice stand or the joint hinge are subdivided into several parts with a corresponding number of hinge points so that the stand or the hinge may be constructed so as to be flatter, that means that construction space is thus provided in the roof area. This may facilitate the cable guiding in the roof area.

According to another, particular characteristic of the invention, the end of the joint hinge may be hinge-coupled with a linear guiding, whereas the linear guiding may be fastened on the other vehicle part. Extreme nodding movements of the vehicle parts relative to each other are occurring when one vehicle part is raised for example, or when it runs off the rails. Hereby, the connection between two vehicle parts has to be able to compensate without damage nodding angles of up to 5°. Thanks to the combination of a linear guiding with a joint hinge or a slidable lattice stand, one part of the nodding angle is compensated by the slidable lattice stand, the other part by the linear guiding. In regular operational conditions, the nodding angles occurring do not exceed 2,5°. The extreme nodding angles of up to 5° described above only occur in particular cases, for example when one of the vehicle parts has to be raised. In the construction according to the invention, the usually occurring nodding angles of up to 2,5° are compensated without problem by the slidable lattice stand or by the hinge joint, whereas bigger angles are additionally compensated by the linear guiding.

As the slidable lattice stand or the joint hinge are subdivided into several parts, nodding angles of approximately 7° may be realized, so that the subdivision is exposed to a small strain when extreme nodding angles are occurring.

Such a linear guiding consists at least of one axle that is slidable parallel to its longitudinal axis and that may be thus received by a guiding facility. The guiding facility is hereby designed as a housing that may be received, particularly pivotably, by a console preferably, through the other vehicle part. If no slidable lattice stand or joint hinge but only a linear guiding were provided, said linear guiding might wear off quite fast, since, when such nodding movements are occurring, such a linear guiding is also always submitted to bending. The slidable lattice stand however is not submitted to bending.

The connection between the two vehicle parts is provided with a lower plain bearing arranged in the bottom area of the vehicle parts, said plain bearing serving among others to transmit push and pull forces during the movement of the vehicles.

BRIEF DESCRIPTION OF THE DRAWINGS

The invention is explained in more detail according to the drawings.

DESCRIPTION OF THE PREFERRED EMBODIMENTS(S)

Figure 1:
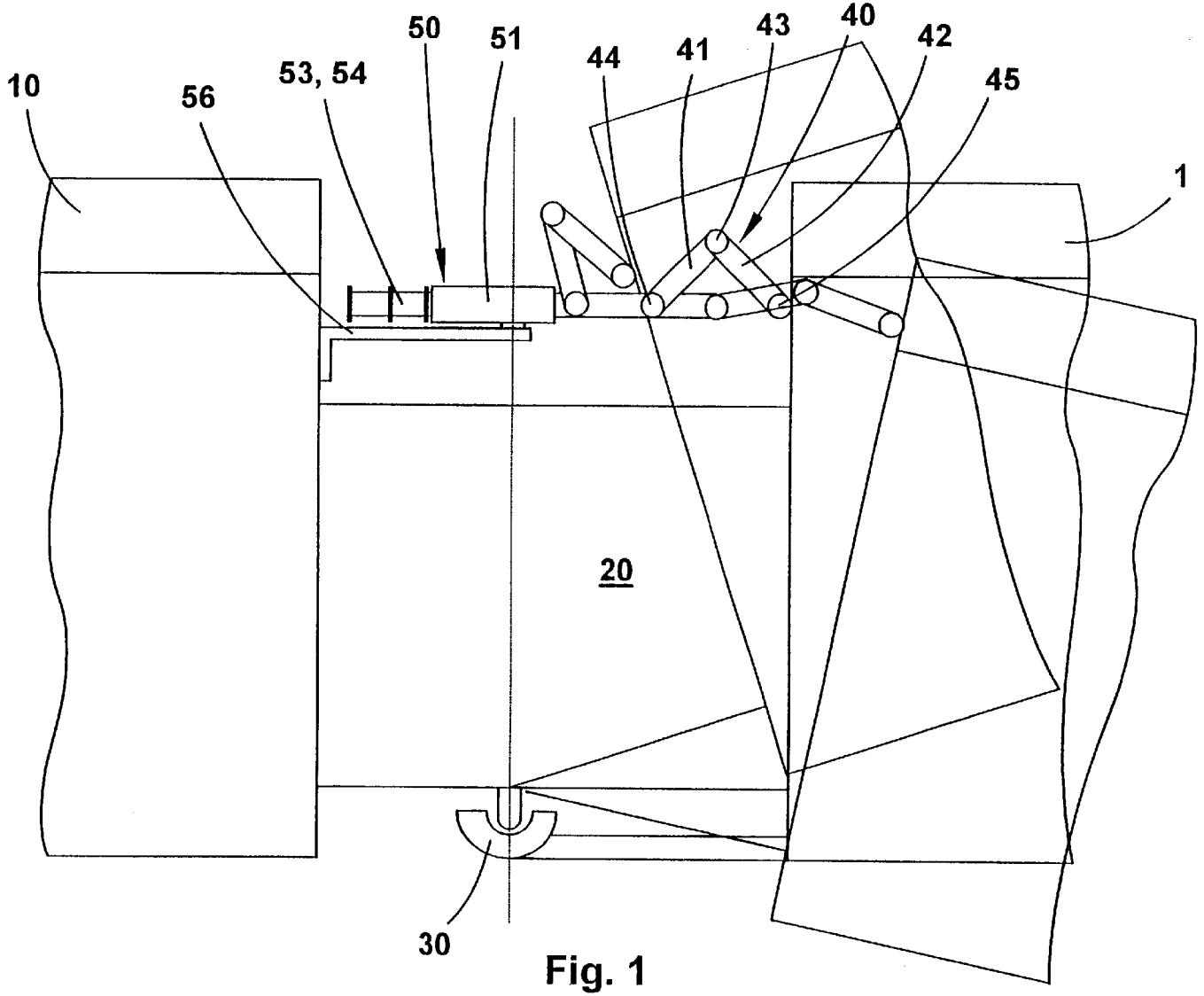
FIG. 1 shows a diagrammatic side view of the connection between two vehicle parts according to the invention
Figure 2:
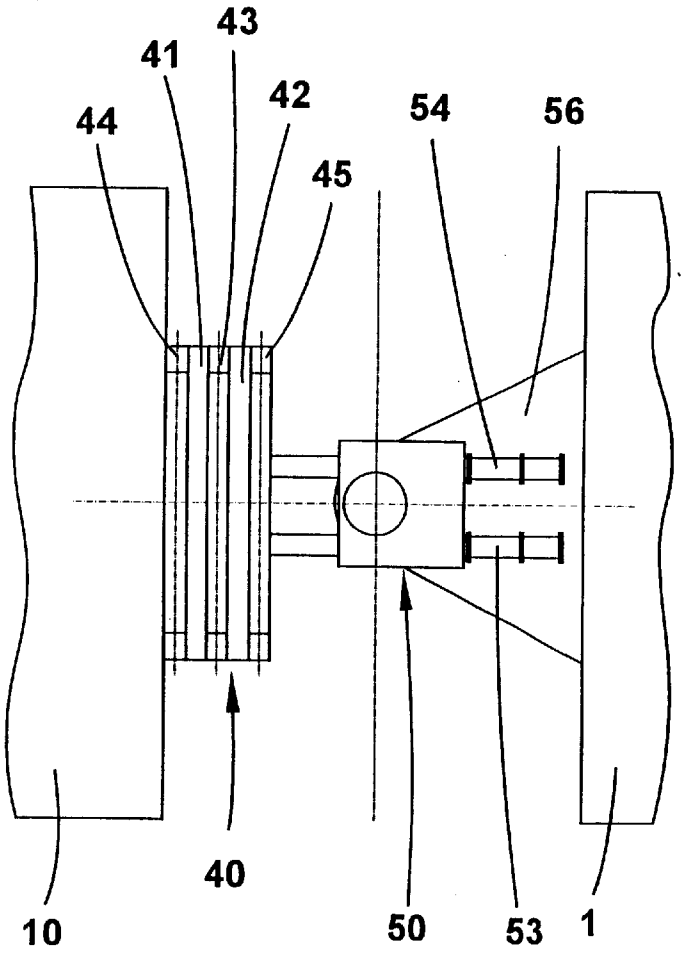
FIG. 2 shows a top view of the articulated vehicle when driving straight.
Figure 3:
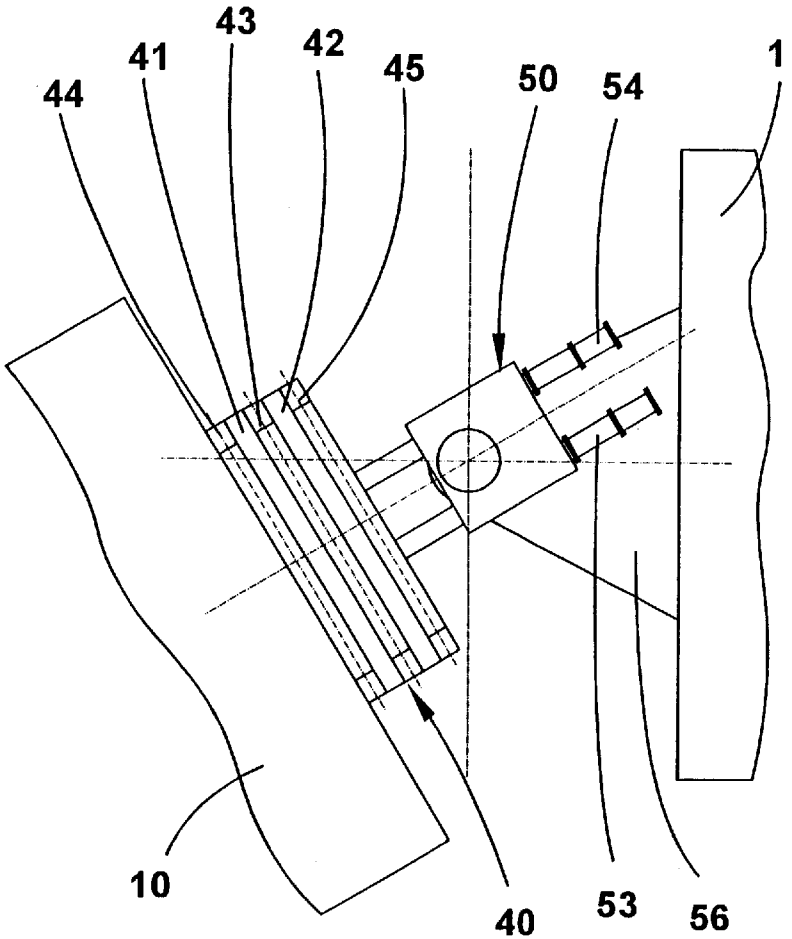
FIG. 3 shows a top view of the articulated vehicle when driving a curve.

According to the FIGS. 1 to 3, the two vehicle parts are designated with the numerals 1 and 10. The two vehicle parts are linked to each other by the connecting corridor 20 shown in a diagrammatic view. The connection of the two vehicle parts 1, 10 in the bottom area of the articulated vehicle is assured by the lower plain bearing 30. Said plain bearing 30 essentially transmits all the forces occurring between the two vehicle parts during the regular travelling motions of an articulated vehicle.

The subject matter of the invention is the connection of the two vehicle parts 1, 10 in the ceiling area, that means above the connecting corridor 20. Hereby, the one vehicle part 1 is provided with the slidable lattice stand designed as a joint hinge 40. Said slidable lattice stand or joint hinge 40 has the two straps 41, 42 that are connected to each other by the joint 43. Each strap 41, 42 also has a joint 44, 45 at its end for the connection with the one vehicle part 1 or through the linear guiding 50 with the other vehicle part 10. The linear guiding 50 consists of a housing 51 with two axles 53, 54 running parallel. Said axles may be received by the housing in such a way that they are axially slidable. Therefore the housing is provided with a corresponding slide bush or with ball thrust bearings. The housing 51 is pivotable on a vertical axis and is borne on the console 56 that is fastened on the other vehicle part 10.

The course of the motions occurring during a nodding movement of the vehicle parts 1, 10 relative to each other, either when driving a depression or when driving over a hilltop is shown in the representation according to FIG. 1.

FIG. 2 particularly shows the extension of the slidable lattice stand or joint hinge across the longitudinal axis of the vehicle. In the end, this alignment of the joint hinge across the longitudinal axis of the vehicle achieves that the forces occurring during swaying movements of the vehicle parts relative to each other are compensated by the joint hinge or by the slidable lattice stand and that they finally have to be intercepted by the vehicle parts 1, 10 themselves on account of their own elasticity.

What is claimed is:

1. Connection between two vehicle or car sections of an articulated vehicle which is articulated and which is provided with a slidable lattice stand or joint hinge, characterized in that, in order to restrain the rocking movement of the car sections (1, 10) relative to each other in the ceiling area of the car sections (1, 10), the two car sections (1, 10) are pivotally connectable by way of the slidable lattice stand or joint hinge 40 which is mounted in a ceiling area of the connection between the car sections (1, 10) and which extends across the longitudinal axis of the articulated vehicle and folds vertically about a transverse, generally horizontal axis.

2. Connection according to claim 1, characterized in that the ends of the slidable lattice stand or joint hinge (40) are hinge-linked at (44 or 45), respectively, with either of the vehicle sections (1, 10).

3. Connection according to claim 1, characterized in that one end of the slidable lattice stand or joint hinge (40) is hinge-coupled with a linear guiding (50), whereas the linear guiding (50) is fastened on the other vehicle section (10).

4. Connection according to claim 3, characterized in that the linear guiding (50) comprises at least one axle (53, 54) that is slidable parallel to its longitudinal axis and that is received by a guiding facility (51).

5. Connection according to claim 4, characterized in that the guiding facility (51) for the axle is designed as a housing (51).

6. Connection according to claim 4, characterized in that the guiding facility (51) is pivotally received by the other vehicle section (10).

7. Connection according to claim 6, characterized in that the guiding facility (51) is pivotally borne on a console (56) that is fastened to the other vehicle section (10) .

8. Connection according to claim 1, characterized in that a lower plain bearing is arranged in the bottom area of the vehicle sections hinged to each other.

* * * * *